US006070776A

United States Patent [19]

Furnary et al.

[11] Patent Number: 6,070,776

[45] Date of Patent: Jun. 6, 2000

[54] BACKPACK LOAD CENTERING SYSTEM

[76] Inventors: Kevin P. Furnary, P.O. Box 673, Niwot, Colo. 80544; Joshua R. Valentine, 440 Stevens Cir., Platteville, Colo. 80651

[21] Appl. No.: 09/120,283

[22] Filed: Jul. 22, 1998

Related U.S. Application Data

[60] Provisional application No. 60/055,006, Aug. 8, 1997.

[51] Int. Cl.[7] ..... A45F 3/04

[52] U.S. Cl. ..... 224/627; 224/631; 224/637

[58] Field of Search ..... 224/627, 631, 224/637

[56] References Cited

U.S. PATENT DOCUMENTS

| | | | |
|---|---|---|---|
| 2,197,427 | 4/1940 | Despain | 224/635 |
| 4,194,656 | 3/1980 | Zufich | 224/631 |
| 5,131,576 | 7/1992 | Turnipseed | 224/637 X |
| 5,184,764 | 2/1993 | Orovan et al. | 224/637 X |
| 5,427,290 | 6/1995 | Thatcher | 224/637 X |
| 5,431,317 | 7/1995 | Kliot | 224/627 X |
| 5,730,347 | 3/1998 | Finot | 224/631 |

FOREIGN PATENT DOCUMENTS

| | | | |
|---|---|---|---|
| 55350 | 10/1938 | Denmark | 224/210 |
| 834457 | 8/1938 | France | 224/209 |
| 881920 | 5/1943 | France | 224/210 |
| 1338893 | 8/1963 | France | 224/210 |
| 2668345 | 4/1992 | France | 224/210 |
| 669836 | 1/1939 | Germany | 224/210 |
| 48230 | 8/1930 | Norway | 224/209 |
| 58853 | 1/1938 | Norway | 224/210 |
| 2223930 | 4/1990 | United Kingdom | 224/211 |
| 9105494 | 5/1991 | WIPO | 224/211 |

*Primary Examiner*—Gregory M. Vidovich
*Attorney, Agent, or Firm*—Terrance L. Siemens

[57] ABSTRACT

A backpack in which length of the shoulder straps automatically adjust as to length when the wearer twists his or her torso. The shoulder straps are connected at their lower end to form one continuous strap. This strap passes below the bottom panel of the backpack, and is contained within a channel. The channel extends along the bottom panel for its entire width from right to left. The channel bends upwardly and forwardly as it exits the bottom panel to follow the side panels of the backpack. A member of low friction characteristics enables the continuous strap to slide freely within the channel. The channel is formed to resist distortion by compression from the load carried within the backpack. The shoulder straps may be elastic, and include an adjustment feature enabling adjustment of their overall length to accommodate different body dimensions.

7 Claims, 6 Drawing Sheets

Prior Art
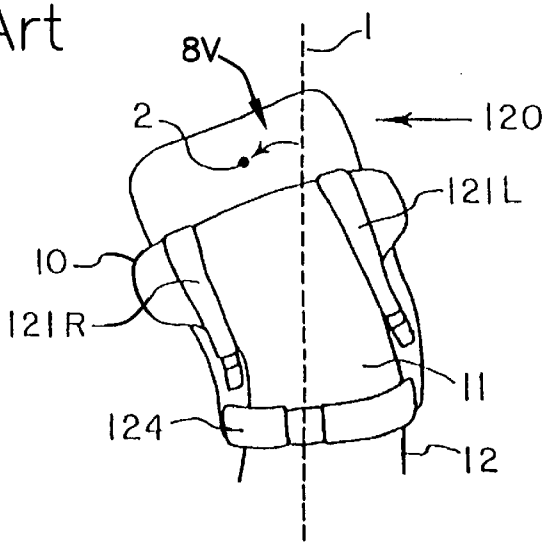
FIG. 1A
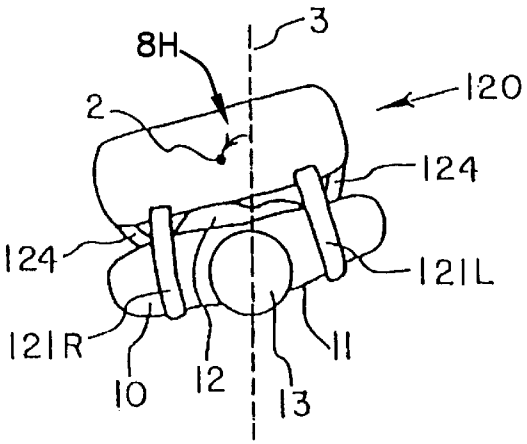
FIG. 1B
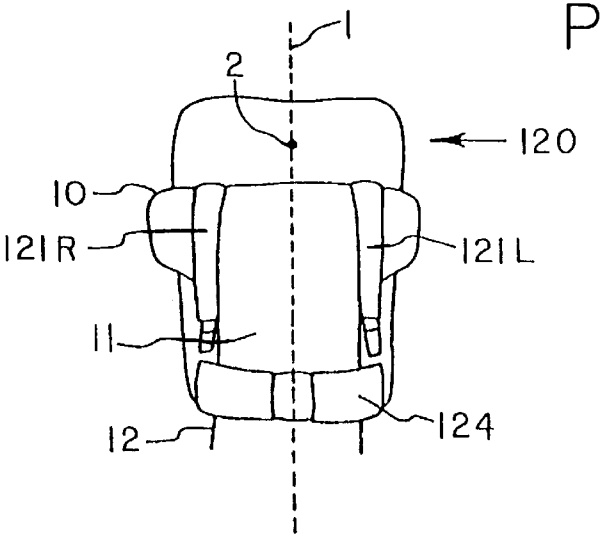
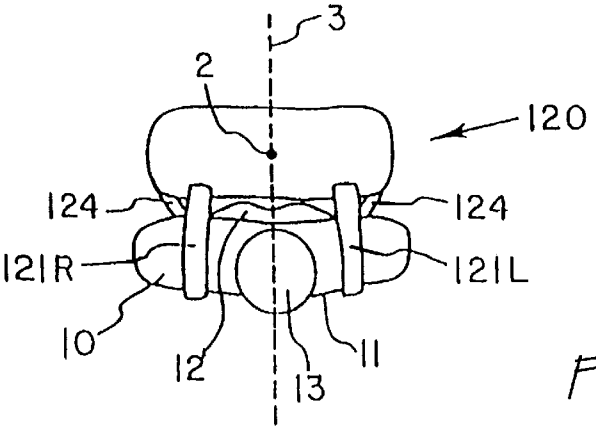

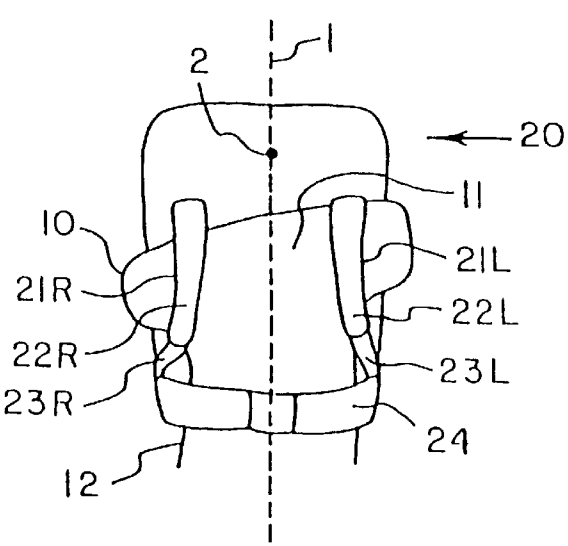
FIG. 2A
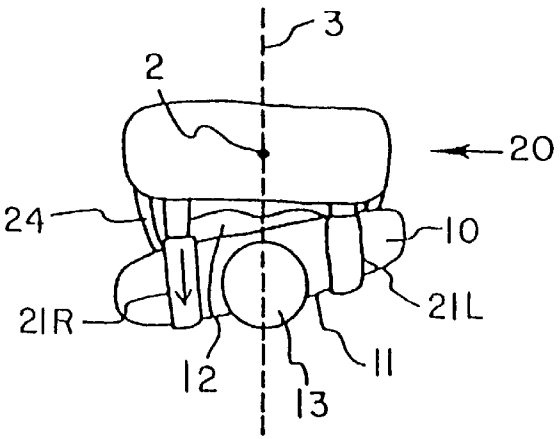
FIG. 2B
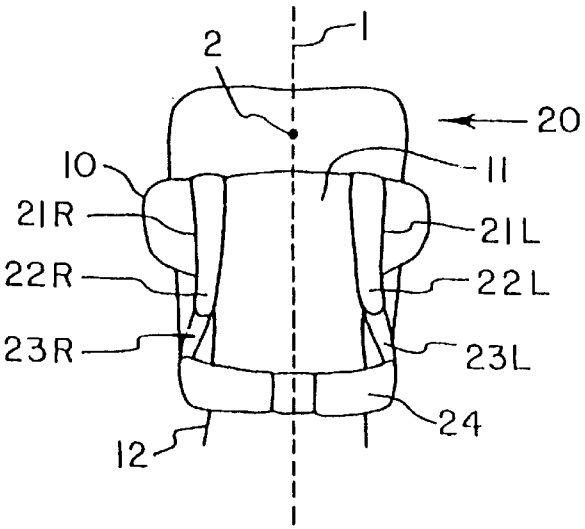
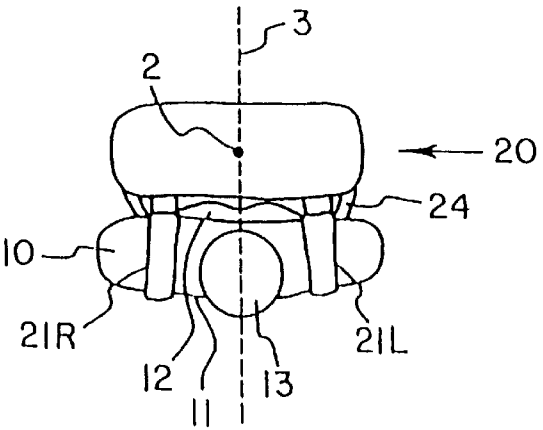

BACKPACK LOAD CENTERING SYSTEM

This application claims the benefit from U.S. Provisional Application No. 60/055,006, filed Aug. 8, 1997.

FIELD OF THE INVENTION

The present invention relates to backpacks in general and specifically to a method for centering the load of a backpack.

BACKGROUND AND SUMMARY OF THE INVENTION

The present invention relates to backpacks in general and specifically to a method for centering the load of a backpack. Specifically, when a backpack wearer twists and/or tilts his torso, he changes the distances between his shoulders and hips. This tilting and/or twisting movement causes a backpack's center-of-load to move with the wearer for two primary reasons: (1) an increase in shoulder-to-hip distance exerts a pull on a fixed length shoulder strap and hence the backpack, and/or (2) a decrease in shoulder-to-hip distance creates slack in a fixed length shoulder strap and hence the load of the backpack on the shoulders shifts to a single shoulder. This movement of the center-of-load can cause the wearer to become unbalanced. Consequently, this movement of the center-of-load can be uncomfortable because strain is put on the back and shoulder muscles to maintain balance. More importantly, this movement of the center-of-load can be dangerous because it can cause the wearer to fall. In fact, situations which can cause the wearer to significantly twist and/or tilt his torso (e.g. traversing or climbing steep slopes, crossing talos slopes, crossing boulder fields, stepping over logs, crossing streams, crossing uneven or slippery terrain, cross country and alpine skiing, or even walking through dense vegetation) are precisely the kinds of situations where wearer balance is crucial and falls can be the most serious.

The present invention provides a backpack with left and right shoulder straps that change length in response to wearer torso twist and/or tilt to compensate for the tendency of these motions to shift the backpack's center-of-load. The principle behind the present invention is that a shoulder strap which adjusts its length in response to a change in shoulder-to-hip distance prevents the pull that would result for a fixed length shoulder strap when the shoulder-to-hip distance increases and removes the slack that would result for a fixed length shoulder strap when the shoulder-to-hip distance decreases. Thus, the present invention compensates for motion that tends to shift a backpack's center-of-load while maintaining a roughly even distribution between the two shoulders of the backpack's load on the wearer's shoulders. The present invention further provides a means to adjust the overall length of each shoulder strap so as to compensate for differences in left side and right side shoulder-to-hip distances that exist in the absence of wearer motion.

In a preferred embodiment, the lower ends of the left and right shoulder straps are standard backpack webbing straps which are joined to form a continuous strap, and pass through a channel on the bottom panel of a backpack. The lower end of the shoulder strap passes between the channel base, which is comprised of a low friction material, and the channel cover which is cupped with the concave side facing the joined webbing straps. In such an embodiment, the joined webbing straps slide within the channel such that one shoulder strap lengthens under the pull of wearer torso twist and/or tilt, while the other shoulder strap correspondingly shortens to take up slack.

In another preferred embodiment, the lower and/or upper ends of the left and right shoulder straps are made of an elastic material. In such an embodiment, the ends of a shoulder strap stretch when the shoulder-to-hip distance increases to prevent a pull on a backpack or contract when the shoulder-to-hip distance decreases to remove slack and prevent an unbalancing distribution of a backpack's load.

In another preferred embodiment, the lower ends of the left and right shoulder straps are wound around cylinders that are under radial tension such that a cylinder takes up slack in a strap. Such a device may comprise a single cylinder or a multiplicity of cylinders and is referred to as an uptake cylinder herein. In such an embodiment, an increase in shoulder-to-hip distance causes the uptake cylinder to reel out more strap and lengthen the strap, while a decrease in shoulder-to-hip distance allows the radial tension of the uptake cylinder to reel in slack and shorten the strap. Further, in such an embodiment, the left and right shoulder straps may be wound around separate and independent uptake cylinders or the same uptake cylinder.

Other embodiments of the above further comprise a means to adjust the overall length of each shoulder strap so as to compensate for differences in left side and right side shoulder-to-hip distances that exist in the absence of wearer motion. This overall shoulder strap length adjustment means further enables the above embodiments to distribute the load of the backpack on the wearer's shoulders in a roughly even manner and to adjust the length of the shoulder straps in response to wearer torso tilt and/or twist.

BRIEF DESCRIPTION OF THE DRAWINGS

FIG. 1, comprising FIGS. 1A–B, shows prior art. FIG. 1, comprising FIGS. 1A–B, illustrates the shift in a conventional backpack's center-of-load when a wearer tilts, FIG. 1A, or twists, 1B, his torso.

FIG. 2, comprising FIGS. 2A–B, illustrates that the present invention compensates for wearer torso tilt, 2A, or twist, 2B, so that the backpack's center-of-load does not shift. FIG. 2A is a front elevational view of the invention, and FIG. 2B is a top plan view thereof, wherein some components of the invention are omitted from these figures for clarity of the view.

FIG. 3, comprising FIG. 3A is a perspective view of the invention, FIG. 3B is a side elevational view thereof, FIG. 3C is a front elevation view thereof, and FIG. 3D is a side elevational view thereof, wherein some components of the invention are omitted from these figures for clarity of the view.

FIG. 4, comprising FIG. 4A is a front elevational view of the invention, and FIG. 4B is a front perspective view thereof, wherein some components of the invention are omitted from these figures for clarity of the view.

DETAILED DESCRIPTION OF THE INVENTION

Figure 3A:
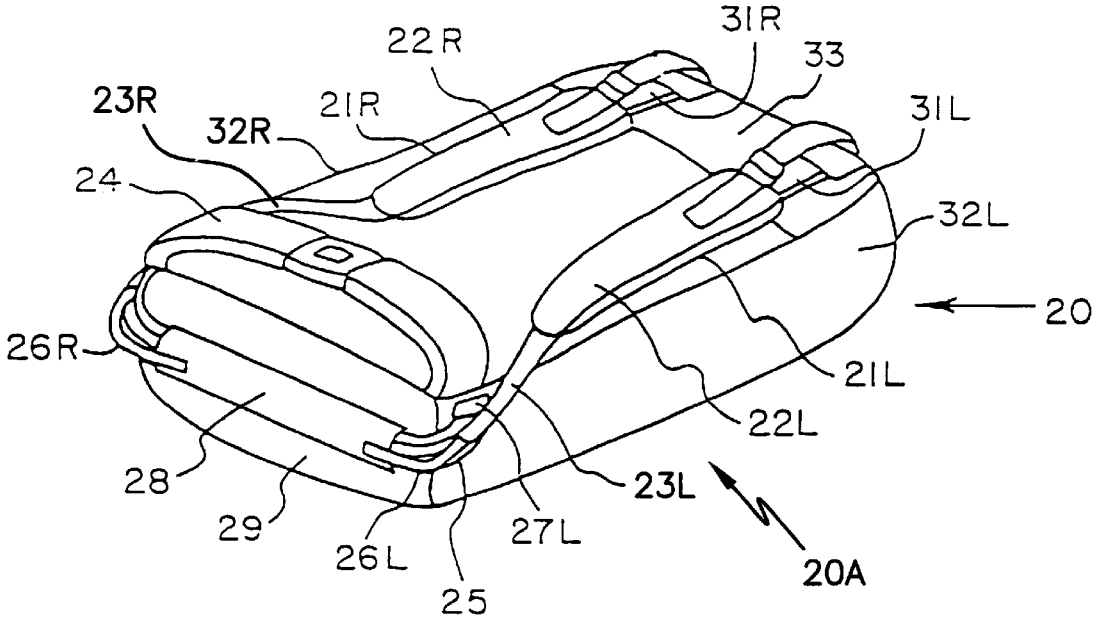
FIGS. 3A–D, shows a preferred embodiment of the present invention. Specifically, a preferred embodiment of an apparatus that enables the shoulder straps to increase or decrease in length.

FIGS. 1A and 1B show prior art. FIGS. 1A and 1B illustrate the shift in a conventional backpack's 120 center-of-load 2 when a wearer tilts, FIG. 1A, or twists, 1B, his torso 11. As can be seen in FIG. 1A, when a wearer tilts, one shoulder 10 to hip 12 distance decreases while the other increases. In FIG. 1A, the wearer's right side shoulder-to-hip distance decreases while the left increases. This motion causes the left shoulder 10 to exert an upward force on the left shoulder strap 121L. Correspondingly, slack develops in the right shoulder strap 121R. Since in a conventional backpack 120 the shoulder strap length is fixed, this vertical motion causes the backpack's center-of-load 2 to shift by $\theta_v$ from its original position. When the center-of-load shifts from the plane 1 normal to the ground and passing through the wearer's center-of-gravity, a torque is exerted on the wearer. Further, the shift of the backpack's center-of-load 2 also causes the primary load bearing element of a backpack, the hip belt 124, to shift with a consequent uneven redistribution of the backpack's load on the wearer's hips 12. Similarly, FIG. 1B illustrates the shift in a conventional backpack's 120 center-of-load 2 when a wearer twists his torso 11, i.e. rotates about an axis roughly defined by a line passing through the center of the wearer's head 13 and hips 12 and in the plane 3 normal to the ground and passing through the wearer's center-of-gravity. As illustrated in 1B, rotation of the right shoulder 10 forward pulls the right shoulder strap 121R forward and consequently causes the center-of-load to shift by $\theta_H$ from its original position. Thus, this shift of the center-of-load 2 by $\theta_H$ results in a torque on the wearer.

Figure 3B:
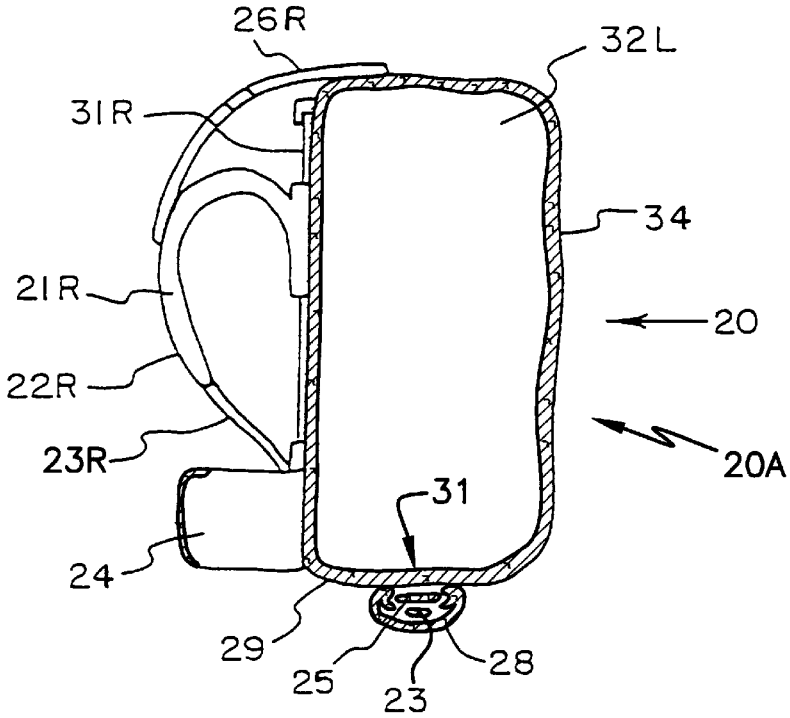

Now consider the operation of a backpack 20 utilizing the present invention, as illustrated in FIGS. 2A and 2B. In FIGS. 2A and 2B a shoulder strap, e.g. 21R, comprises a shoulder pad, e.g. 22R, and a strap lower end, e.g. 23R. As can be seen in FIGS. 3A and 3B, lower ends 23R and 23L are connected together so as to form a webbing strap 23. As can be seen in FIG. 2A, when a wearer tilts his torso 11, decreasing in this instance the right shoulder 10 to hip 12 distance and increasing the left shoulder-to-hip distance, the left strap lower end 23L increases in length and the right strap lower end 23R decreases in length. Thus, the increase in the length of 23L in response to an increase in left shoulder to left hip distance prevents the wearer motion from pulling the backpack's center-of-load 2 out of the plane 1 which is normal to the ground and passes through the wearer's center-of-gravity. In addition, the decrease in the length of right strap lower end 23R in response to a decrease in right shoulder to right hip distance prevents the wearer motion from shifting the load of the backpack on the shoulders primarily to the left shoulder. Consequently, the backpack's center-of-load 2 remains roughly in plane 1, a position that facilitates optimum wearer balance. Further, the compensatory change in length of the shoulder straps 21R and 21L prevents the hip belt 24 from substantially shifting and unevenly distributing the load of a backpack on the wearer's hips 12. Similarly in FIG. 2B, wearer torso twist that moves the right shoulder forward is compensated for by an increase in the length of the right shoulder strap 21R and a decrease in the length of the left shoulder strap 21L. Consequently, the center-of-load 2 roughly remains in the plane 3 normal to the ground and passing through the center of the wearer's hips 12 and the wearer's center-of-gravity. This position of the center-of-load 2 facilitates optimum wearer balance.

FIGS. 3A to 3D show a preferred embodiment of the present invention. FIG. 3A shows a backpack 20, with bottom panel 29, a back panel 33, a left side panel 32L, a right side panel 32R, a hip belt 24, a right frame stay 31R, a left frame stay 31L, a right shoulder strap 21R (comprising a shoulder pad 22R and a lower end 23R), a left shoulder strap 21L (comprising a shoulder pad 22L and a lower end 22L), and webbing strap stops 26R and 26L. Backpack 20 includes a body 20A which receives the load (not shown) carried by the backpack 20 in a cavity (not shown). The webbing strap stops 26R and 26L limit the maximum extension of the right shoulder strap 21R and left shoulder strap 21L lengths respectively. The webbing strap 23 joins the shoulder straps 21R and 21L and passes through a channel defined and formed by a channel cover 28, attached to the bottom panel 29, and a channel base 25. The channel cover 28 may be attached to the bottom panel 29 with stitching, rivets, snaps, glue, laces, passage, through loops attached to the bottom panel 29, or a hook-loop material such as Velcro, or combinations thereof. The channel base 25 extends out of the channel, curves up each of the side panels 32R and 32L and terminates in affixing means 27R and 27L (27R not shown in the figures but is understood to be opposite affixing means 27L). In a preferred embodiment, the affixing means 27R and 27L are pockets stitched onto the side panels 32R and 32L, respectively, into which the ends of the channel base 25 slip. However, the affixing means 27R and 27L may also independently be rivets, snaps, glue, laces, or a hook-loop material such as Velcro, or combinations thereof.

FIG. 3B illustrates in cross-section a preferred embodiment of how channel base 25 and channel cover 28 form a channel. The channel base 25 is made of a semi-rigid material that has low friction or is coated on the surface facing webbing strap 23 with a friction-reducing material. In a preferred embodiment, the channel base 25 is a thin strip, roughly one sixteenth inch thick, of polypropylene. In another preferred embodiment, the channel base 25 is a thin strip, roughly one sixteenth inch thick, of Teflon. The channel cover 28 may be any of a number of woven materials known to the field, such as canvas or nylon. The material that comprises the channel cover 28 is folded to create a cupped surface with the concave side facing webbing strap 23 and the channel base 25. As can be seen in FIG. 3B, the tips of the folded channel cover material define the inner sides of the channel and the channel base 25 extends past the tips of the folded channel cover material. This configuration of channel cover 28 and channel base 25 creates a cupped channel that prevents the load of a backpack from compressing webbing strap 23 between channel base 25 and channel cover 28, which would impair or eliminate the ability of webbing strap 23 to slide within the channel. Thus, it should be recognized that FIG. 3B shows only one of many possible embodiments of the channel. A further embodiment of the channel comprises a channel base as described above and a channel cover made of a semi-rigid material. Another embodiment of the channel is an open ended semi-rigid tube, for example small diameter PVC tubing, with the inner surface of the tube wall in contact with bottom panel 29 made of or coated with a low friction material.

Figure 3D:
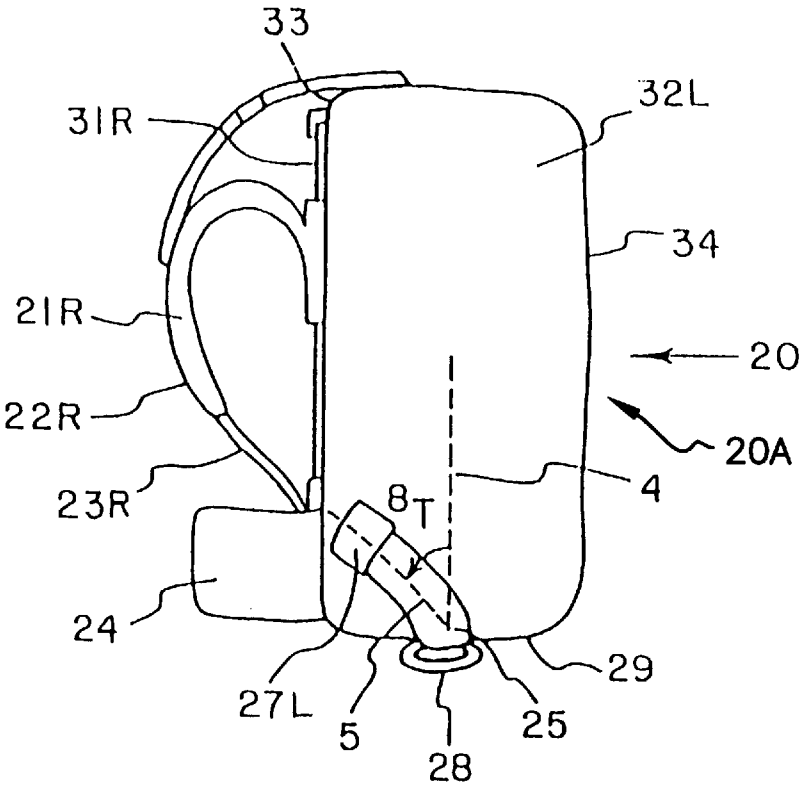
Figure 3C:
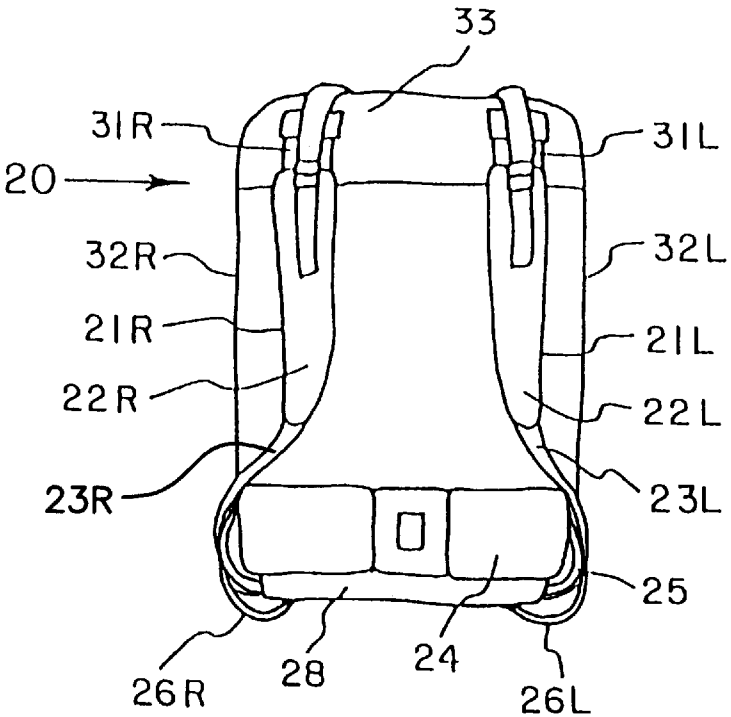

FIG. 3C shows the curvature in the channel base 25 as it extends up the side panels 32R and 32L and terminates in affixing means 27R and 27L. This curvature facilitates the ability of webbing strap 23 to slide in response to wearer torso twist and/or tilt by enabling webbing strap 23 to slide on the low friction material of channel base 25 instead of the backpack's side panels 32R and 32L. Such a configuration is a preferred embodiment because backpack side panels are typically made of a high friction material and possess a tendency, when a backpack is loaded, to bulge out at the bottom further increasing friction with a strap disposed along or across the bottom edge of a side panel. Thus, another embodiment comprises side panels 32R and 32L where the areas over which webbing strap 23 moves are made of a low-friction material or coated with a low friction material. Another embodiment comprises utilizing rotatable curved surfaces attached to the side panels such that webbing strap 23 may slide over the rotatable curved surfaces. Another embodiment comprises utilizing fixed curved low friction surfaces attached to the side panels such that webbing strap 23 may slide over the rotatable curved surfaces.

FIG. 3D shows the placement of the channel with respect to a backpack's back panel 33 and front panel 34 and the extension of channel base 25 up side panel 32L. It should be noted that, the left shoulder strap 21L has ben omitted from FIG. 3D for the sake of clarity in illustrating channel base 25. Likewise, for the sake of clarity in illustrating channel base 25, webbing strap 23 is not shown passing over channel base 25 or through the channel formed by channel base 25 and channel cover 28. On a given side of a backpack, dashed line 4 is defined by a line normal to the edge formed by bottom panel 29 and a side panel of the given side at the point where the middle of channel base 25 intersects this edge. On a given side of a backpack, dashed line 5 is defined by the point where the middle of channel base 25 intersects the edge formed by bottom panel 29 and the side panel of the given side and the point where the middle of channel base 25 is projected to intersect the edge formed by the back panel 33 and a side panel of the given side. The channel formed and defined by channel base 25 and channel cover 28 is disposed roughly midway between back panel 33 and front panel 34. The middle of the channel base 25 extends up a given side panel at an angle $\theta_T$ to roughly the mid-point of the edge formed by the hip belt 24 and the side panel of the given side. The angle $\theta_T$ is chosen such that webbing strap 23 remains on the channel base 25 as the shoulder straps 21R and 21L change length. The above dispositions form a preferred embodiment for two reasons: (1) when a backpack is loaded the portion of the bottom panel 29 closest to front panel 34 tends to sag below the portion closest to back panel 33 which compresses and rotates the channel increasing friction within it, and (2) this permits webbing strap 23 to traverse from the channel to its attachment to a shoulder strap at an angle $\theta_T$ which facilitates the ability of the shoulder straps 21R and 21L to change length in response to wearer torso tilt and/or twist. Thus, another embodiment comprises utilizing rotatable cylinders attached to the side panels, with their axes oriented roughly perpendicular to $\theta_T$ on the given side to which they are attached, such that webbing strap 23 may slide over the rotatable cylinders. A further embodiment comprises utilizing fixed half-cylinder low friction surfaces attached to the side panels, with their axes oriented roughly perpendicular to $\theta_T$ on the given side to which they are attached, such that webbing strap 23 may slide over the half-cylinder low friction surfaces. It will be seen in FIG. 3D that hip belt 24 projects forwardly of body 20A.

Figure 4A:
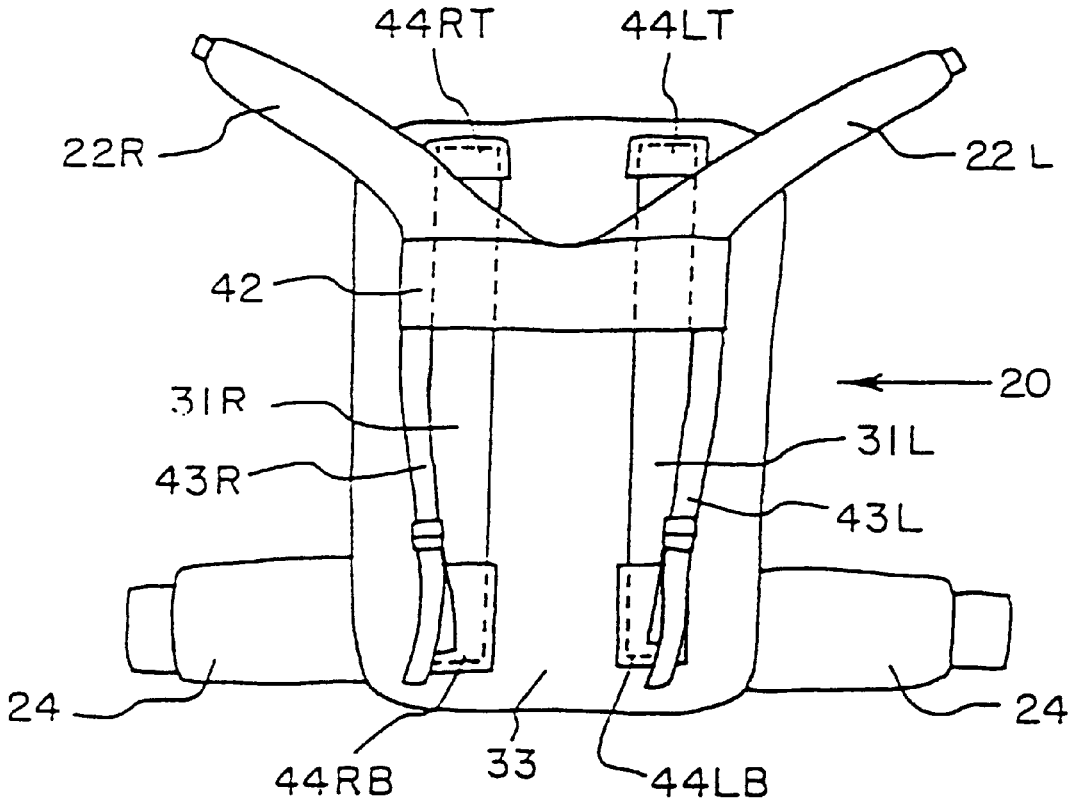
FIGS. 4A–B, shows a preferred embodiment of an overall shoulder strap length adjustment means.

FIG. 4A shows a preferred embodiment of an overall shoulder strap length adjustment means. Backpack frame stays 31R and 31L are attached to back panel 33 by, respectively, affixing means 44RT and 44RB, and 44LT and 44LB. In a preferred embodiment, the affixing means 44RT and 44RB, and 44LT and 44LB are pockets stitched to back panel 33. However, affixing means 44RT and 44RB, and 44LT and 44LB may also be, rivets, snaps, glue, laces, loops attached to back panel 33, or a hook-loop material such as Velcro, or combinations thereof. The shoulder pads 22R and 22L are attached to a shoulder pad harness 42. In a preferred embodiment, the shoulder pads 22R and 22L are stitched to shoulder pad harness 42. However, the shoulder pads 22R and 22L may also be attached by rivets, snaps, glue, laces, loops attached to shoulder pad harness 42, or a hook-loop material such as Velcro, or combinations thereof. The slots in the shoulder harness 42 enable the shoulder harness 42 to slide on a backpack's frame stays 31R and 31L. The compression straps 43R and 43L are attached at one end to shoulder harness 42 and attached at the other end to back panel 33 at a point below the lowest point of desired travel for shoulder harness 42. The overall shoulder strap length may be changed by tightening or loosening the compression straps 43R and 43L, i.e. the right compression strap 43R is utilized to change the overall length of the right shoulder strap 21R. The compression straps 43R and 43L may be independently attached in a variety of ways such as with stitches, rivets, snaps, glue, laces, loops attached to shoulder pad harness 42 and/or back panel 33, or a hook-loop material such as Velcro, or combinations thereon.

Figure 4B:
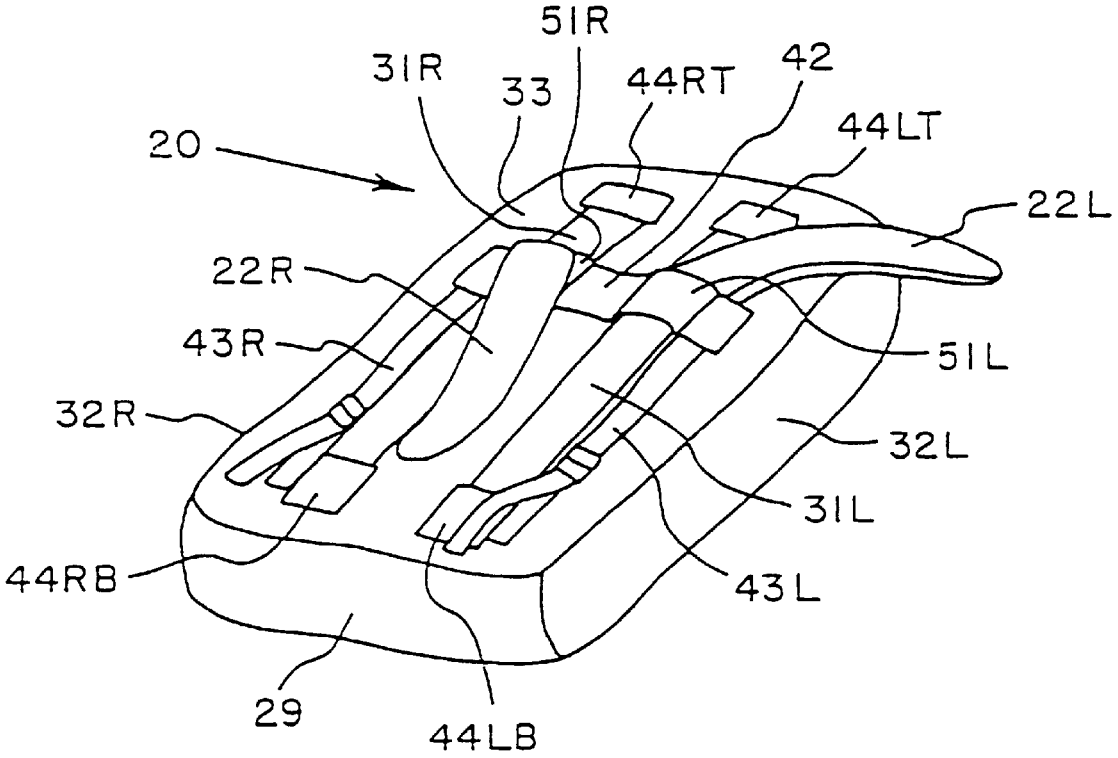

It should be noted that although FIG. 4A illustrates a preferred embodiment where shoulder harness 42 joins the shoulder pads 22R and 22L, another embodiment may be utilized where the shoulder harness 42 is split into two separate harnesses that do not join shoulder pads 22R and 22L. Further, it should be noted that although FIG. 4A illustrates a preferred embodiment where compression straps 43R and 43L attach to shoulder harness 42 at points exterior to the region between the frame stays 31R and 31L, compression straps 43R and 43L may also be attached to shoulder harness 42 at points between frame stays 31R and 31L. FIG. 4B illustrates the slots 51R and 51L in the shoulder harness 42 through which the frame stays 31R and 31L respectively pass.

We claim:

1. A backpack having a load centering system, for being worn on the back of a wearer, said backpack comprising:

a body for receiving a load, having a bottom panel, a back panel, a front panel, a left side panel, a right side panel all joined together to form a cavity within said body, said bottom panel having a width spanning and extending between said left side panel and said right side panel;

a hip belt joined to said body and projecting forwardly therefrom;

a right shoulder strap portion having an upper end attached to said body at a first point of attachment on said body, and a lower end, and a left shoulder strap portion having an upper end attached to said body at a second point of attachment on said body spaced apart from said first point of attachment, and a lower end;

a webbing strap connecting said lower end of said right shoulder strap portion to said lower end of said left shoulder strap portion; and a channel cover connected to said bottom panel of said body, wherein said channel cover spans a substantial portion of said width of said bottom panel of said body, is oriented along said bottom panel from said right side panel to said left side panel, and forms a channel which encircles and retains said webbing strap within said channel cover, said right shoulder strap portion along with a portion of said webbing defining a right shoulder strap having a length and said left shoulder strap portion along with a portion of said webbing defining a left shoulder strap having a length, wherein said webbing strap is disposed to slide within said channel and said right shoulder strap and said left shoulder strap each change length when the user twists his or her torso, wherein when one of said right shoulder strap and said left shoulder strap lengthens responsively to twisting of the torso, the other one of said right shoulder strap and said left shoulder strap correspondingly shortens, thereby compensating for bodily motion which would otherwise tend to shift a center-of-load of said backpack.

2. The backpack according to claim 1, further comprising a semi-rigid channel base disposed within said channel between said webbing strap and said bottom panel of said body of said backpack, wherein said channel base presents a surface characterized by low friction to said webbing strap to enable said webbing strap to slide easily within said channel.

3. The backpack according to claim 1, wherein said right shoulder strap comprises elastic material and said left shoulder strap comprises elastic material, whereby said right shoulder strap and said left shoulder strap each stretch when subjected to a pulling force.

4. The backpack according to claim 1, further comprising means for adjusting said first point of attachment and said second point of attachment of said right shoulder strap portion and said left shoulder strap portions, respectively.

5. The backpack according to claim 2, wherein said channel cover is folded to create a cupped surface having a concave side facing said webbing strap, thereby preventing the load of said backpack from compressing said webbing strap between said channel base and said channel cover.

6. The backpack according to claim 2, wherein said channel base extends beyond said bottom panel of said body, and is bent to project upwardly and forwardly along said right side panel of said body and along said left side panel of said body.

7. A backpack having a load centering system, for being worn on the back of a wearer, said backpack comprising:

a body for receiving a load, having a bottom panel, a back panel, a front panel, a left side panel, a right side panel all joined together to form a cavity within said body, said bottom panel having a width spanning and extending between said left side panel and said right side panel;

a hip belt joined to said body and projecting forwardly therefrom;

a right shoulder strap portion having an upper end attached to said body at a first point of attachment on said body, and a lower end, and a left shoulder strap portion, an upper end attached to said body at a second point of attachment on said body spaced apart from said first point of attachment, and a lower end, a webbing strap connecting said lower end of said right shoulder strap portion to said lower end of said left shoulder strap portion; a channel cover connected to said bottom panel of said body; wherein said channel cover spans a substantial portion of said width of said bottom panel of said body, is oriented along said bottom panel from said right side panel to said left side panel, and forms a channel which encircles and retains said webbing strap within said channel cover; said right shoulder strap portion along with a portion of said webbing strap defining a right shoulder strap having a length and said left shoulder strap portion along with a portion of said webbing strap defining a left shoulder strap having a length, wherein said right shoulder strap comprises elastic material and said left shoulder strap comprises elastic material, whereby said right shoulder strap and said left shoulder strap each stretch when subjected to a pulling force;

wherein said webbing strap is disposed to slide within said channel and said right shoulder strap and said left shoulder strap each change length when the user twists his or her torso, wherein when one of said right shoulder strap and said left shoulder strap lengthens responsively to twisting of the torso, the other one of said right shoulder strap and said left shoulder strap correspondingly shortens, thereby compensating for bodily motion which would otherwise tend to shift a center-of-load of said backpack;

said backpack further comprising a semi-rigid channel base disposed within said channel between said webbing strap and said bottom panel of said body of said backpack, wherein said channel base presents a surface characterized by low friction to said webbing strap to enable said webbing strap to slide easily within said channel; wherein said channel cover is folded to create a cupped surface having a concave side facing said webbing strap, thereby preventing the load of said backpack from compressing said webbing strap between said channel base and said channel cover, wherein said channel base extends beyond said bottom panel of said body, and is bent to project upwardly and forwardly along said right side panel of said body and along said left side panel of said body; and means for adjusting said first point of attachment and said second point of attachment of said right shoulder strap portion and said left shoulder strap portion, respectively.

* * * * *